US008105226B2

(12) United States Patent
Wada

(10) Patent No.: US 8,105,226 B2
(45) Date of Patent: Jan. 31, 2012

(54) SPOUT MOUNTING METHOD AND SPOUT

(75) Inventor: Tsuyoshi Wada, Osaka (JP)

(73) Assignee: Fuji Seal International, Inc. (JP)

( * ) Notice: Subject to any disclaimer, the term of this patent is extended or adjusted under 35 U.S.C. 154(b) by 76 days.

(21) Appl. No.: 12/376,098

(22) PCT Filed: Jun. 27, 2007

(86) PCT No.: PCT/JP2007/000709
§ 371 (c)(1),
(2), (4) Date: Feb. 2, 2009

(87) PCT Pub. No.: WO2008/015773
PCT Pub. Date: Feb. 7, 2008

(65) Prior Publication Data

US 2009/0308023 A1 Dec. 17, 2009

(30) Foreign Application Priority Data

Jul. 31, 2006 (JP) ..... 2006-209052

(51) Int. Cl.
*B31B 1/84* (2006.01)

(52) U.S. Cl. ..... 493/213; 493/212; 493/379; 53/133.1; 53/133.2

(58) Field of Classification Search ..... 493/374, 493/379, 210, 212, 213; 53/133.1, 13, 133.2
See application file for complete search history.

(56) References Cited

U.S. PATENT DOCUMENTS 4,430,069 A * 2/1984 Carlisle ..... 493/203
5,606,844 A * 3/1997 Takagaki et al. ..... 53/410
5,678,732 A * 10/1997 Gianpaolo ..... 222/107
6,145,736 A * 11/2000 Ours et al. ..... 229/117.3
6,668,517 B2 * 12/2003 Hiramoto et al. ..... 53/133.2
6,745,540 B2 * 6/2004 Hiramoto et al. ..... 53/133.2
6,751,928 B2 * 6/2004 Hiramoto et al. ..... 53/133.2

(Continued)

FOREIGN PATENT DOCUMENTS

EP 0800994 A1 10/1997

(Continued)

OTHER PUBLICATIONS

International Search Report for International Application No. PCT/JP2007/000709; Date of mailing Oct. 2, 2007; with English translation.

(Continued)

*Primary Examiner* — Christopher Harmon
(74) *Attorney, Agent, or Firm* — Cantor Colburn LLP

(57) ABSTRACT

A spout mounting method and a spout that enable smooth and high-speed mounting of the spout onto a pouch. The method includes an insertion step of inserting the spout (S) into the pouch (P) so that a mounting portion (IP) of the spout (S) is held between not-yet-sealed opening edges, a temporary fixation step of temporarily fixing the spout (S), inserted in the pouch (P), to the pouch (P), and a sealing step of fixing the mounting portion (IP) of the spout (S), temporarily fixed to the pouch (P), to the opening edges of the pouch (P) by heat-sealing. In the temporary fixation step, the opening edges of the pouch (P) are fixed together by spot-sealing near edges on both sides of the mounting portion (IP) of the spout (S) so that the spout (S) is held by the opening edges of the pouch (P).

8 Claims, 9 Drawing Sheets

U.S. PATENT DOCUMENTS 7,121,428 B2 * 10/2006 Hiramoto ..... 221/210

FOREIGN PATENT DOCUMENTS

| | | | |
|---|---|---|---|
| JP | 9-77098 | A | 3/1997 |
| JP | 2004-255742 | A | 9/2004 |
| JP | 2005-59880 | A | 3/2005 |
| JP | 2006-7630 | A | 1/2006 |
| WO | 2005/014399 | A1 | 2/2005 |

OTHER PUBLICATIONS

ISR and Written Opinion of the International Searching Authority PCT/ISA/210 and 237 (In Japanese), Oct. 2, 2007.

* cited by examiner

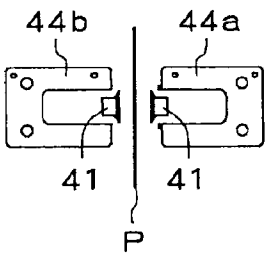
FIG. 5(a)
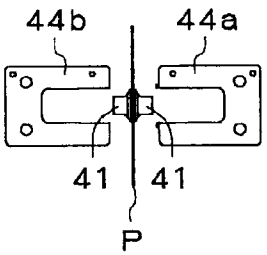
FIG. 5(c)
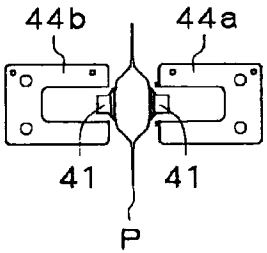
FIG. 5(e)
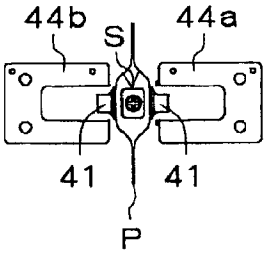
FIG. 5(g)
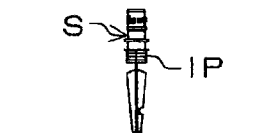
FIG. 5(b)
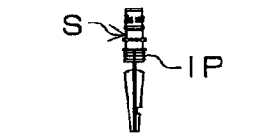
FIG. 5(d)
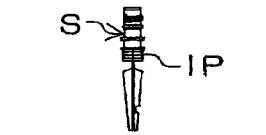
FIG. 5(f)
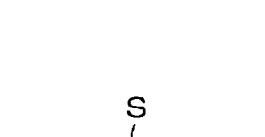
FIG. 5(h)
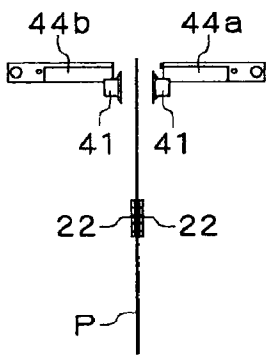
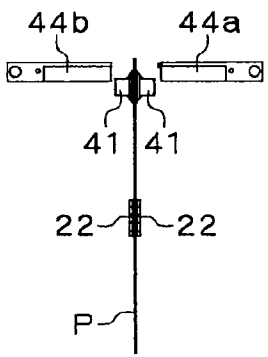
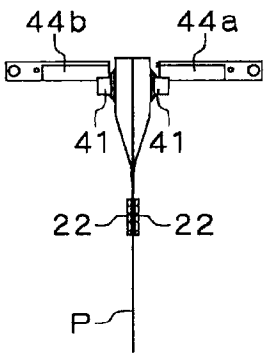
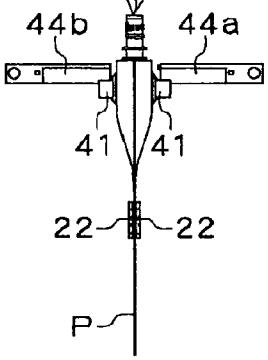

(b)

SPOUT MOUNTING METHOD AND SPOUT

TECHNICAL FIELD

The present invention relates to a spout mounting method for mounting a spout onto a pouch, and a spout.

BACKGROUND ART

A pouch container having a spout for drinking or pouring mounted onto an upper edge portion of a pouch which includes side gusset portions formed of a flexible sheet such as a synthetic resin film or the like, for example, is often manufactured as follows. Specifically, a pouch having upper edge portions not yet heat-sealed is pre-manufactured through a separate process, and a spout is inserted into the pouch such that a mounting portion of the spout is sandwiched between the open upper edge portions of the pouch, and, in this state, the upper edge portions of the pouch are sealed by heat-sealing, thereby mounting the spout onto the pouch.

Here, the operation of mounting a spout onto a pouch as described above is generally performed in steps by transporting the pouch intermittently to each operation site where the pouch is sequentially stopped for the operation at each operation site. Here, if a series of operations from insertion of the spout into the pouch to heat-sealing are performed at the same operation site, fixing of the spout to the pouch by heat-sealing, which requires a certain amount of time, must be performed after the insertion of the spout into the pouch. This disadvantageously inhibits a high-speed operation of mounting the spout onto the pouch.

Accordingly, rather than inserting the spout into the open upper edge portions of the pouch P and sealing whole of the upper edge portions by heat-sealing to mount the spout onto the pouch immediately after this insertion process, a center portion of a mounting portion IP of the spout S which is inserted into the upper edge portions UE of the pouch P is temporarily fixed to the upper edge portions UE of the pouch P by spot-sealing, and, with the pouch and the spout in that state, the pouch P is transported to the next operation site, where the upper edge portions as a whole are heat-sealed to thereby mount the spout onto the pouch P, as shown in FIG. 12. Here, in FIG. 12, the shaded portions correspond to the heat-sealed regions of the pouch P and reference codes PS indicate the spot-sealed portion.

Patent Document 1: JP 2004-255742 A

Patent Document 2: JP 2006-7630 A

SUMMARY

However, even when the pouch P is fixed to the spout S by spot-sealing as described above, it is necessary to place both a portion of the contact surface of the pouch P and a portion of the contact surface of the spout S into a melted state in order to partially fix the pouch P to the spout S by heat-sealing, and a certain amount of time is required for melting the surface of the spout S, which is relatively hard and thick. As such, high-speed operation of mounting the spout S onto the pouch P even in this case should be restricted.

Further, in the type of pouch container described above, because the spout S is generally mounted to a center portion in the width direction of the pouch P, when the center portion of the mounting portion IP of the spout P is to be fixed to the upper edge portions UE of the pouch P by spot-sealing, a seal head SH must be disposed at the center portion in the width direction of the pouch P, as shown in FIG. 13. Consequently, in order to widen the open upper edge portions UE of the pouch P, suction heads VH used for this purpose must be placed on the respective sides of the seal head SH such that two points located on the outward sides in the width direction of the pouch P are sucked by the respective suction heads SH to open the upper edge portions of the pouch P. In this case, however, the opening amount of the upper edge portions UE of the pouch P is reduced compared to that when the center portion in the width direction of the pouch P is sucked to widen the open upper portions UE of the pouch P, which makes it difficult to insert the spout S into the upper edge portions UE of the pouch P. This problem becomes serious especially when the pouch P has a smaller width, and in some cases, the suction heads VH may be detached from the pouch P.

Accordingly, at least an embodiment of the present invention advantageously provides a spout mounting method which allows a smooth and high-speed operation of mounting a spout onto a pouch, and a spout.

BRIEF DESCRIPTION OF THE DRAWINGS

Embodiments of the invention will be explained in the description below, in connection with the accompanying drawings, in which:

FIG. 2(*b*) is a side view showing a spout;

FIG. 2(*c*) is a side view showing a spout;

FIG. 4(*b*) is a side view showing the above spout insertion and temporary fixation unit;

FIGS. 5(*a*) to (*h*) are process views for explaining the temporary fixation operation of the spout performed by the above spout insertion and temporary fixation unit;

FIG. 7(*b*) is a cross sectional view along X-X line of FIG. 7(*a*);

FIG. 8(*b*) is a cross sectional view taken along X-X line of FIG. 8(*a*);

FIG. 10(*b*) is a cross sectional view taken along X-X line of FIG. 10(*a*);

FIG. 10(*c*) is a cross sectional view taken along Y-Y line of FIG. 10(*a*);

DETAILED DESCRIPTION OF THE PREFERRED EMBODIMENTS

Figure 1:
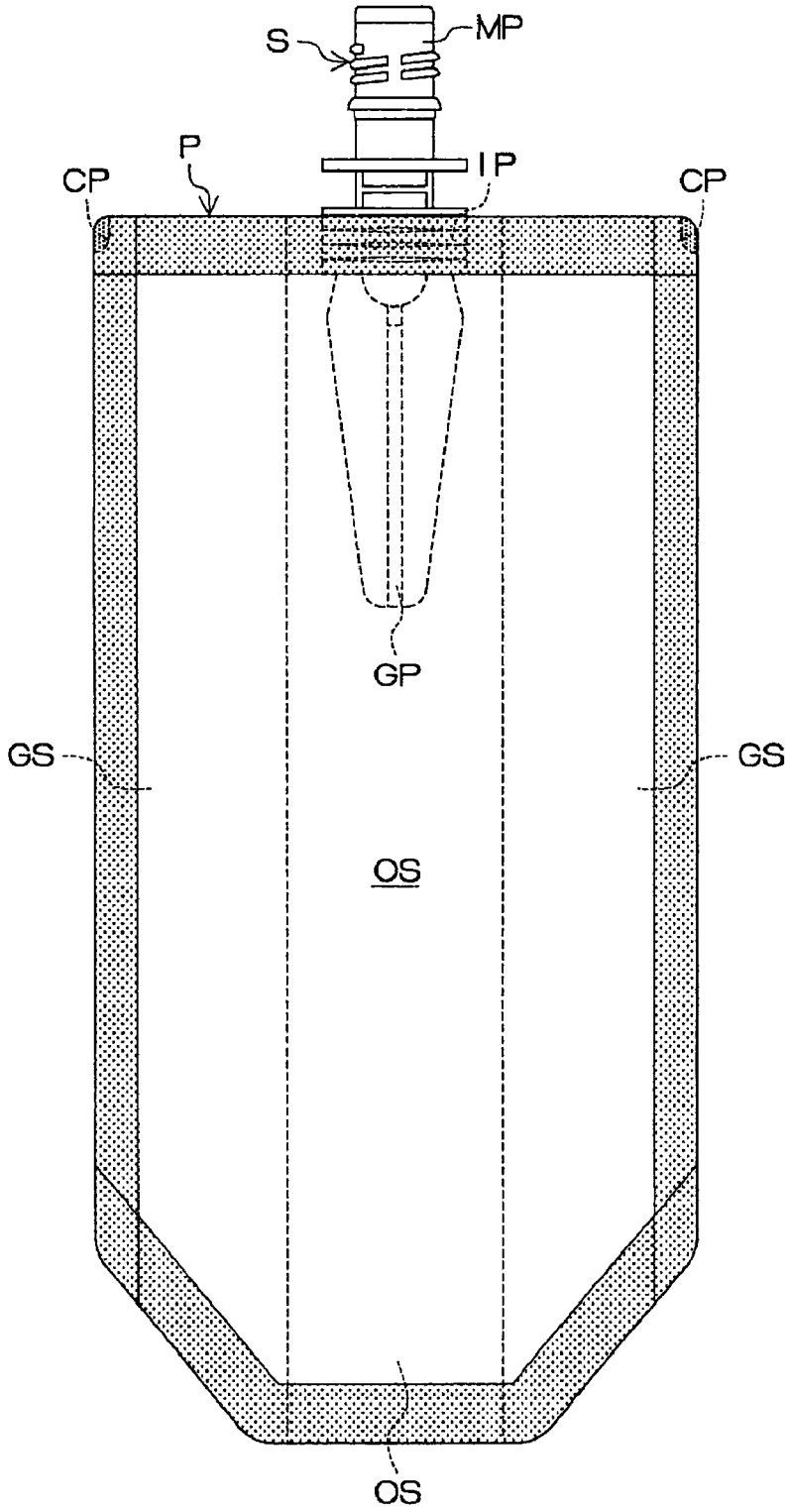
FIG. 1 is a front view showing a pouch container having a spout, in which a spout is mounted onto a pouch by a spout mounting method according to at least and embodiment of the present invention.

In order to solve the above problems, there is provided, according to the invention as described in claim 1 of this application, a spout mounting method for mounting a spout onto a pouch, including an insertion step of inserting the spout into the pouch such that a mounting portion of the spout is held between opening edges of the pouch which have not been sealed, a temporary fixing step of temporarily fixing the spout which is inserted into the pouch to the pouch, and a sealing step of fixing the mounting portion of the spout which is temporarily fixed to the pouch onto the pouch by heat-sealing, wherein during the temporary fixing step, the opening edges of the pouch are fixed together near both side edges of the mounting portion of the pouch by spot-sealing, such that the spout is held by the opening edges of the pouch.

Further, according to claim 2, in the spout mounting method according to claim 1, when at least one side edge of the mounting portion of the spout in the width direction of the pouch, which is to be fixed to the opening edges of the pouch by heat-sealing, is formed in a flat thin shape, at the time of fixing the opening edges of the pouch together by spot-sealing during the temporary fixing step, the opening edges of the pouch and the flat thin side edge in the mounting portion of the spout are fixed together by spot-sealing.

Also, in order to solve the above problems, there is provided, according to claim 3, a spout to be mounted onto a pouch, including a mounting portion to be fixed to an opening edge of the pouch by heat-sealing, the mounting portion including at least one side edge in the width direction of the pouch which is formed in a flat thin shape, wherein a portion of the side edge having a flat thin shape is cut out toward the center of the mounting portion to form a cut edge portion.

Further, according to claim 4, there is provided a spout mounting method for mounting the spout according to claim 3 onto a pouch, including an insertion step of inserting the spout into the pouch such that a mounting portion of the spout is held between opening edges of the pouch which have not been sealed, a temporary fixing step of temporarily fixing the spout which is inserted into the pouch to the pouch, and a sealing step of fixing the mounting portion of the spout which is temporarily fixed to the pouch onto the pouch by heat-sealing, wherein during the temporary fixing step, the opening edges of the pouch are fixed together near both side edges of the mounting portion of the pouch by spot-sealing, such that a sealed region is fitted in the cut edge portion formed in the side edge of the mounting portion of the spout having a flat thin shape.

As described above, with the spout mounting method according to claim 1, during the temporary fixing step, the opening edges of the pouch are fixed to each other by spot-sealing near both side edges of the mounting portion of the spout. Accordingly, it is possible to hold the spout at a predetermined position of the pouch using a holding force of the opening edges of the pouch which hold the spout, without any need to fix the pouch directly to the spout by spot-sealing. Also, in comparison with the conventional spout mounting method in which the center portion of the mounting portion of the spout which is inserted into the pouch is temporarily fixed onto the opening edges of the pouch by spot-sealing, the time required for the temporary fixing of the spout can be reduced. It is therefore possible to achieve a smooth and high-speed operation of mounting the spout onto the pouch.

Further, with the above spout mounting method, in which portions of the pouch on the outward sides with respect to the spout are to be fixed to each other by spot-sealing, it is possible to open the opening edges of the pouch while holding the center portion of the mounting portion of the spout by suction. Consequently, when compared to conventional spout mounting methods in which two points of the pouch on the outward sides in the width direction must be held by suction so as to open the opening edges of the pouch because the spot-sealing is to be applied to the center portion of the mounting portion of the spout, the opening amount of the opening edges of the pouch is increased, which advantageously makes it easy to insert the spout into the pouch. This advantage is effective especially for a small size pouch having a small width, in which the opening edges cannot be sufficiently widened.

Further, when at least one side edge of the mounting portion of the spout in the width direction of the pouch, which is to be fixed to the opening edges of the pouch by heat-sealing, is formed in a flat thin shape, by fixing the opening edges of the pouch and this side edge having a flat thin shape together by spot-sealing when fixing the opening edges of the pouch together by spot-sealing during the temporary fixation step as in the spout mounting method according to claim 2, it is possible to increase the ability to hold the spout with respect to the pouch in the temporary fixation state without significantly increasing the time required for the temporary fixation of the spout, compared to the spout mounting method according to claim 1.

Also, with the spout according to claim 3, because at least one side edge of the mounting portion of the spout in the width direction of the pouch, which is to be fixed to the opening edges of the pouch by heat-sealing, is formed in a flat thin shape and a portion of the side edge having such a flat thin shape is cut out toward the center of the mounting portion to form a cut edge portion, by adopting the spout mounting method according to claim 4 in which the opening edges of the pouch are fixed together by spot-sealing near the both side edges of the mounting portion of the spout such that a sealed region is fitted in the cutedge portion formed in the side edge of the mounting portion of the spout having a flat thin shape, it is possible to increase the ability to hold the spout with respect to the pouch in the temporary fixation state with completely no increase in the time required for the temporary fixation of the spout, compared to the spout mounting method according to claim 1.

BEST MODE FOR CARRYING OUT THE INVENTION

Embodiments of the present invention will be described with reference to the drawings. FIG. 1 shows a pouch container provided with a spout, which is obtained by mounting a spout S shown in FIGS. 2(*b*) and 2(*c*) onto a pouch P shown in FIG. 2(*a*) according to the spout mounting method of the present invention.

Figure 2A:
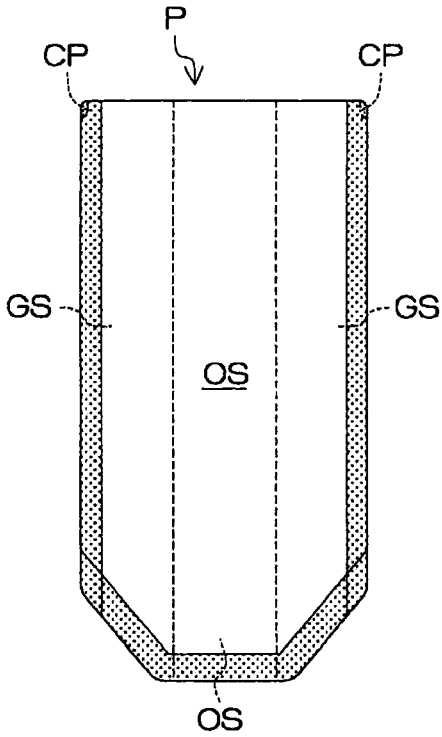
FIG. 2(*a*) is a front view showing a pouch before a spout is mounted.
Figure 2B:
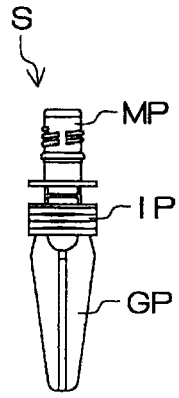
Figure 2C:
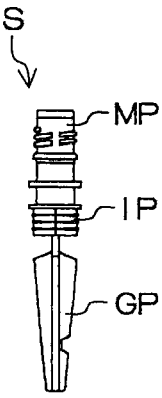

As shown in FIG. 1, the pouch P having the spout S mounted thereon is formed of a pair of front and back outer sheets OS and a pair of right and left gusset sheets GS which are folded inward from both sides of the both outer sheets OS to form right and left gusset portions, respectively. The outer edges of an inner surface of each folded gusset sheet is fixed to the inner surfaces of the outer sheets OS by heat-sealing, and also the upper edge portions and the lower edge portions of the inner surface of the outer sheets OS are also sealed by heat-sealing, so that the pouch P is formed in a bag shape. The gusset sheet GS includes, at the upper end portions of both side edges, cut-out portions CP which mutually correspond to each other when the pouch is folded in two, and the upper end portions of both side edges of the outer sheet OS are partially fixed together by heat-sealing via these cut-out portions CP. The pouch P before having the spout S mounted thereon is previously manufactured in a separate process, and in this state, the upper edge portions of the outer sheet OS are not heat-sealed, as shown in FIG. 2(*a*). In FIGS. 1 and 2(*a*), the shaded portions indicate the heat-sealed portions of the pouch P.

As shown in FIGS. 1, 2(*b*), and 2(*c*), the spout S is formed of a mouth portion MP through which a liquid product contained in the pouch P is poured: a mounting portion IP having a boat-shape cross section, which is continuously formed with the mouth portion MP; and a guide portion GP which is continuously formed with the mounting portion IP. The mounting portion IP is fixed to the pouch P by heat-sealing in a state where the mounting portion IP is held between the upper edges of the pouch.

Figure 3:
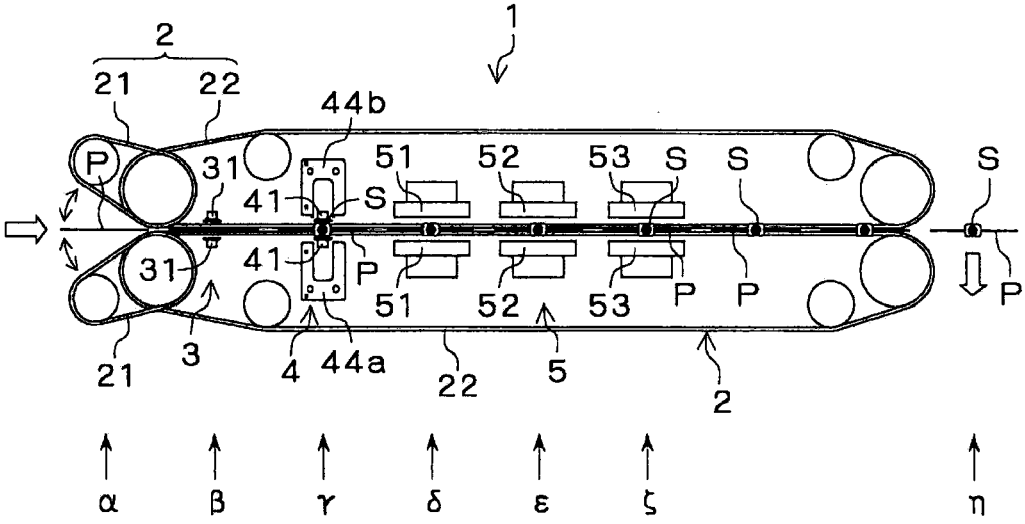
FIG. 3 is a plan view schematically showing a spout mounting device used for implementing the spout mounting method described above.

FIG. 3 shows a spout mounting device 1 used for implementing the spout mounting method described above. The spout mounting device 1 includes a pouch transporting unit 2, a pouch preliminary opening unit 3, a spout insertion and temporary fixation unit 4, and a spout mounting unit 5. The pouch transporting unit 2 transports the pouch P which is supplied to a pouch supply position α in an upright state by a pouch supply unit, which is not shown, sequentially to a pouch preliminary opening position β, a spout insertion position γ, a first seal position δ, a second seal position ϵ, a cooling position ζ, and a discharge position η. The pouch preliminary opening unit 3 opens the opening edges of the pouch at the pouch preliminary opening position β by separating the opening edges away from each other while holding the opening edges using the suction from a pair of preliminary suction heads 31. The spout insertion and temporary fixation unit 4 inserts the spout S supplied by a spout supply unit which is not shown into the pouch P at the spout insertion position γ and temporarily fixes the spout S to the pouch, and the spout mounting unit 5 fixes the spout S, which is temporarily fixed to the pouch P, to the pouch P by heat-sealing to thereby mount the spout S onto the pouch P.

The pouch transporting unit 2 includes an open/close belt transporting mechanism 21 which can be opened or closed on the pouch supply position α side and a belt transporting mechanism 22. The open/close belt transporting mechanism 21 sandwiches the pouch P which has been supplied to the pouch supply position α by the pouch supply unit in an upright state and transports the pouch P toward the pouch preliminary opening position β side. The belt transporting mechanism 22 sandwiches the pouch P being transported by the open/close belt transporting mechanism 21 and transports the pouch P sequentially to the pouch preliminary opening position β, the spout insertion position γ, the first seal position δ, the second seal position ϵ, the cooling position ζ, and the discharge position η. The open/close transporting mechanism 21 and the belt transporting mechanism 22 are configured to sandwich the portion of the pouch P located under the spout S which is mounted.

The spout insertion and temporary fixation unit 4 includes a chuck for suspending the spout S supplied by the spout supply unit while holding the mouth portion of the spout S, a chuck elevating mechanism for moving the chuck upward and downward, a chuck moving mechanism for moving the chuck between the spout supply position (not shown) and the spout insertion position γ, a pair of suction heads 41 and 41 which open the opening edges of the pouch P at the spout insertion position γ, and a pair of sealing heads 44*a* and 44*b* for temporarily fixing the spout inserted into the pouch P to the pouch P. The spout insertion and temporary fixation unit 4 is configured such that, by descending the chuck holding the spout S by the chuck elevating mechanism positioned at the spout insertion position γ, the spout S is inserted into the pouch P through the upper edge opening portions of the pouch P which are opened by the pair of suction heads 41 and 41.

Figure 4A:
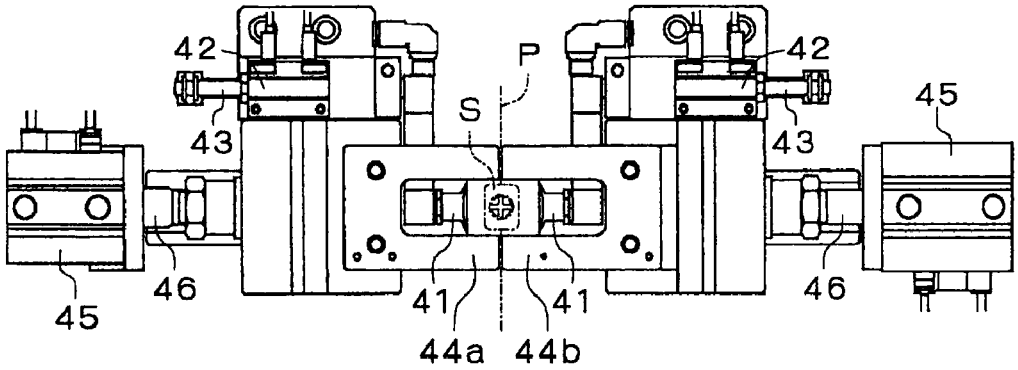
FIG. 4(*a*) is a plan view showing a spout insertion and temporary fixation unit in the above spout mounting device.
Figure 4B:
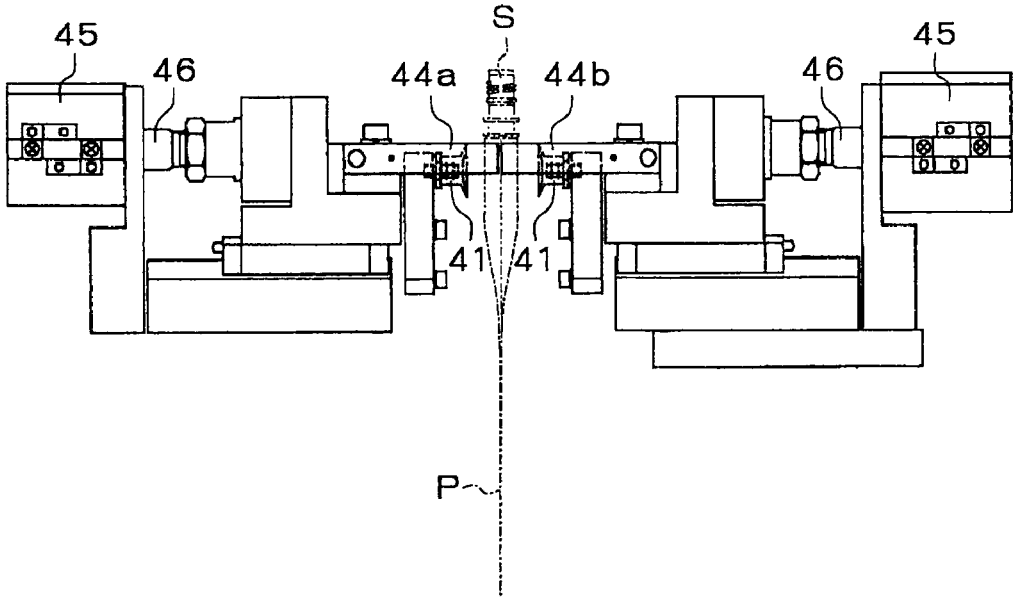
Figure 6A:
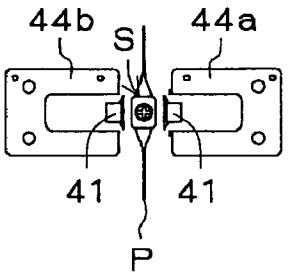
FIGS. 6(*a*) to (*f*) are process views for explaining the temporary fixation operation of the spout performed by the above spout insertion and temporary fixation unit.
Figure 6C:
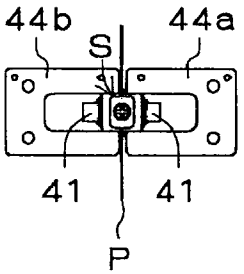
Figure 6E:
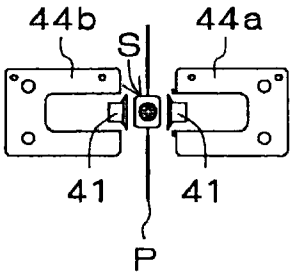
Figure 6B:
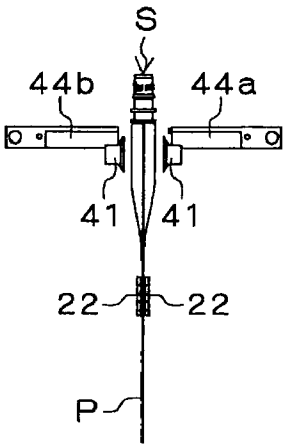
Figure 6D:
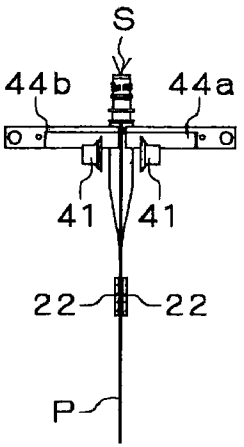
Figure 6F:
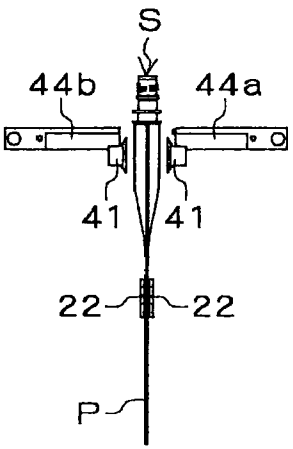

As shown in FIGS. 4(*a*) and 4(*b*), each suction head 41 is coupled with a piston rod 43 of each driving cylinder 42. The pair of suction heads 41 and 41, after holding the center portion of the pouch P in the width direction at the opening edges thereof by suction, withdraw apart from each other to thereby open or widen the opening edges of the pouch P.

As shown in FIGS. 4(*a*) and 4(*b*), each of a pair of sealing heads 44*a* and 44*b* is formed in a U shape surrounding each of the pair of suction heads 41 and 41 as seen in plan view, and is also coupled with the piston rod 46 of each driving cylinder 45. By sandwiching the opening edges of the pouch P at the outward sides with respect to the spout S by the pair of sealing heads 44*a* and 44*b*, the opening edges of the pouch can be fixed to each other by spot-sealing at portions near both side edges of the mounting portion IP of the spout S.

With reference to FIGS. 5 and 6, the operations performed by the spout insertion and temporary fixation unit 4 will be described. When the pouch P and the spout S are transported to the spout insertion position γ as shown in FIGS. 5(*a*) and 5(*b*), the pair of suction heads 41 and 41 hold the center portions of the pouch P in the width direction at the opening edges thereof by suction as shown in FIGS. 5(*c*) and 5(*d*). Thereafter, as shown in FIGS. 5(*e*) and 5(*f*), the suction heads 41 and 41 are withdrawn away from each other to thereby open the opening edges of the pouch P.

Then, as shown in FIGS. 5(*g*) and 5(*h*), the spout S is inserted into the pouch P such that the mounting portion IP of the spout S is opposed to the unsealed opening edges of the pouch P. After the spout S is thus inserted into the pouch P, when the pair of suction heads 41 and 41 release the suction holding the pouch P, the opening edges of the pouch P are closed so that the mounting portion IP of the spout S is sandwiched between the opening edges of the pouch P, as shown in FIGS. 6(*a*) and 6(*b*).

Figure 7A:
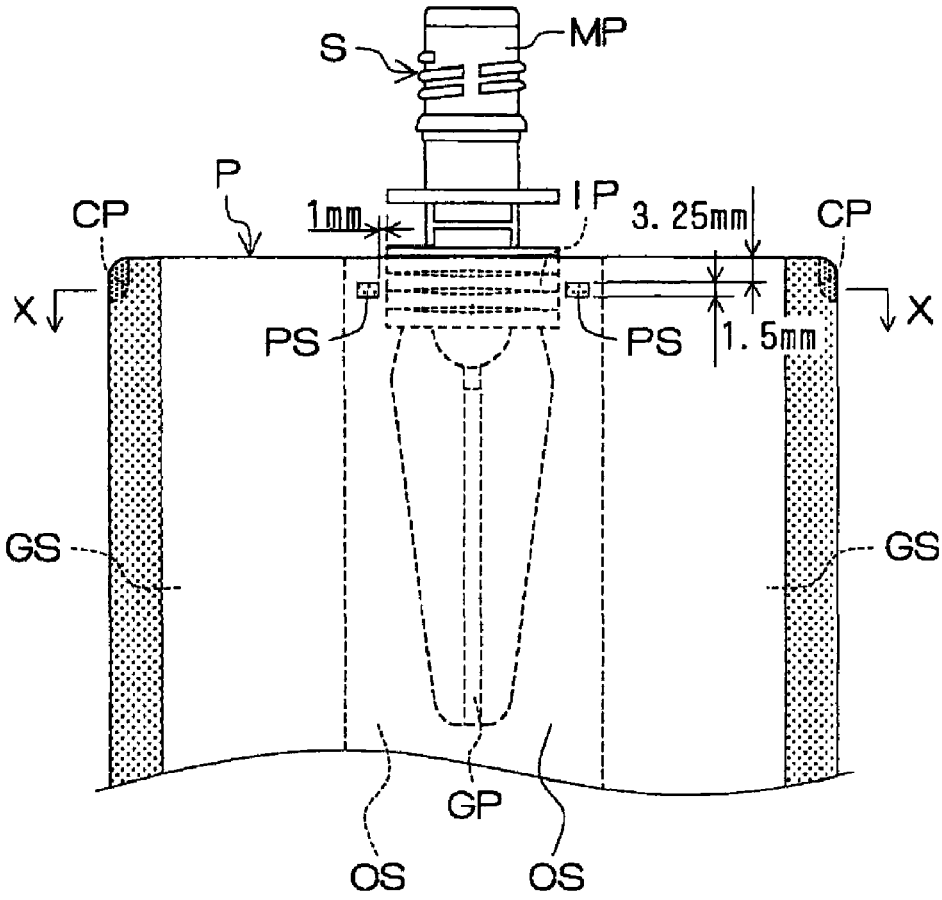
FIG. 7(*a*) is a partial front view showing the spout in a temporarily fixed state according to the above spout mounting method.
Figure 7B:
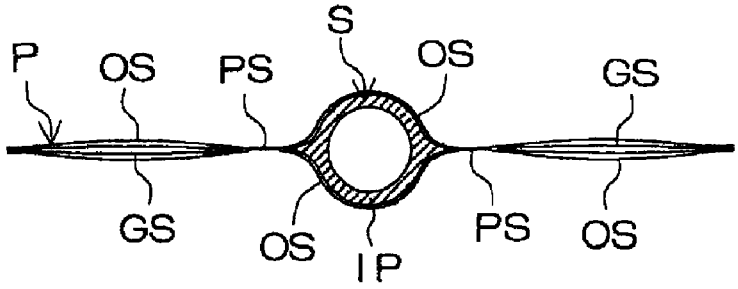

Finally, after the opening edges of the pouch P at the outward sides of the spout S are held by the pair of sealing heads 44*a* and 44*b* as shown in FIGS. 6(*c*) and 6(*d*), by withdrawing the sealing heads 44*a* and 44*b* away from each other as shown in FIGS. 6(*e*) and 6(*f*), the opening edges of the pouch P are fixed to each other by spot-sealing at portions near the both side edges of the mounting portion IP of the spout S so that the spout S is held by the pouch P as shown in FIGS. 7(*a*) and 7(*b*). Here, PS in FIGS. 7(*a*) and 7(*b*) indicates the spot-sealed portions.

The spot-sealed portion PS of the pouch P described above is in the shape of a rectangle having a height of 1.5 mm and a width of 2.5 mm, and is disposed at a position with an interval of 1 mm from the side edge of the mounting portion IP of the spout S and at the center in the height direction of the mounting portion IP of the spout S (i.e. with an interval of 3.25 mm from the upper edge of the pouch P).

The spout mounting unit 5 includes a pair of first sealing bars 51 which sandwich the opening edges of the pouch P onto which the spout S has been temporarily fixed, to fix the opening edges together by heat-sealing, thereby mounting the spout S onto the pouch P at the first seal position δ; a pair of second sealing bars 52 which sandwich the upper end edges of the pouch P having the spout S mounted thereon to completely heat-seal the upper edges, thereby sealing the upper end opening portions of the pouch P at the second seal position ϵ; and a pair of cooling bars 53 which sandwich the sealed upper end opening portions of the pouch P for cooling at the cooling position ζ. On both sides of the transporting path for the pouch P between the first seal position δ and the pouch stop position following the cooling position ζ, a pair of guide plates (not shown) which guide the portion of the spout S projecting through the pouch P are provided so as to prevent the pouch P having the spout S mounted thereon from being bent.

Figure 12:
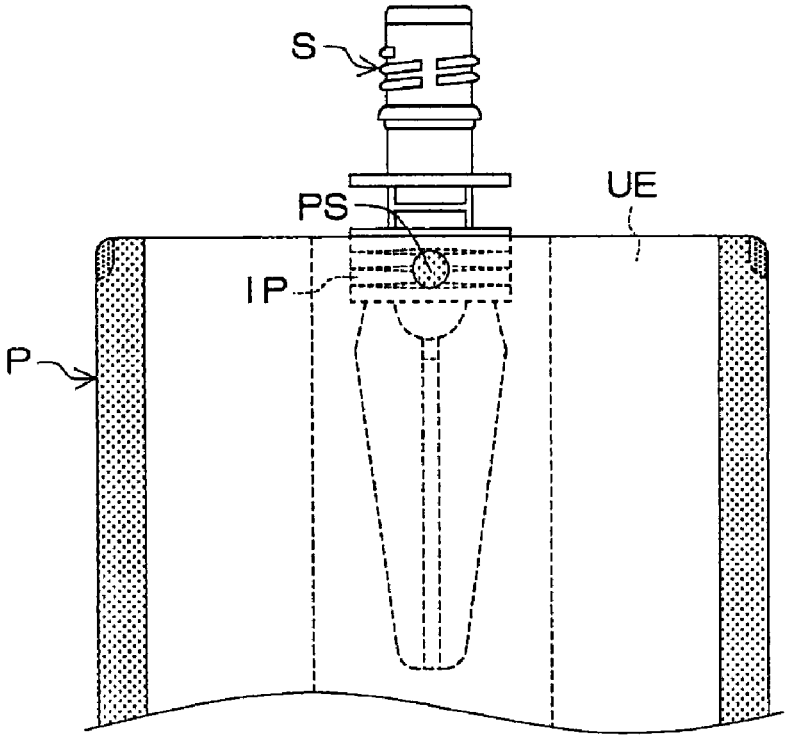
FIG. 12 is a partial front view showing a spout in a temporarily fixed state according to a conventional spout mounting method.

As described above, because the spout mounting device 1 is configured such that the opening edges of the pouch P are fixed together by spot-sealing at portions near both side edges of the mounting portion IP of the spout S such that the spout S is held by the opening edges of the pouch P, it is possible to hold the spout S at a predetermined mounting position of the pouch P by the holding force of the opening edges of the pouch P holding the spout S, without any need to directly fix the pouch P onto the spout S by spot-sealing. Also, in comparison with conventional spout mounting methods in which the spout S is temporarily fixed onto the pouch P by fixing the center portion of the mounting portion IP of the spout S which is inserted into the pouch P to the opening edges of the pouch P by spot-sealing as shown in FIG. 12, the time required for temporary fixation of the spout S can be reduced. It is therefore possible to achieve smooth and high-speed operation of mounting the spout S onto the pouch P.

Figure 13:
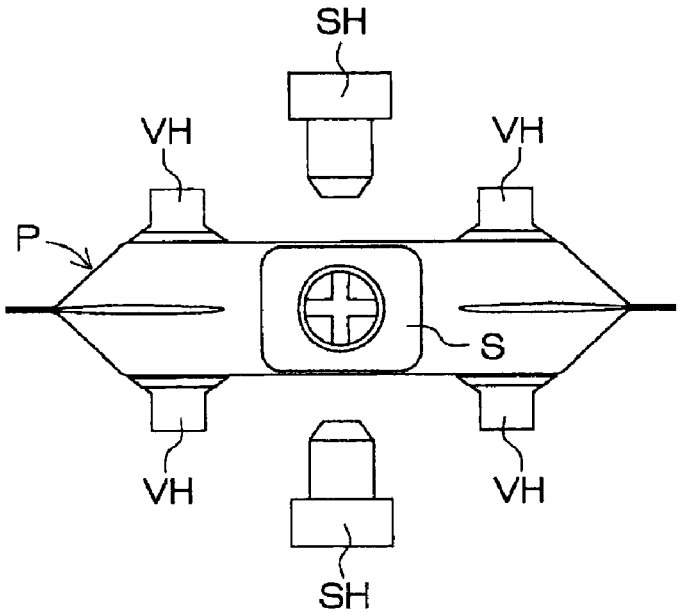
FIG. 13 is a view for explaining a method of widening the opening of a pouch according to the conventional spout mount method and the related problems.

Further, in a case wherein spot-sealing is applied at locations on the outward sides of the mounting portion IP of the spout S as with the spout insertion and temporary fixation unit 4 of the spout mounting device 1 of the present invention, it is possible to open the opening edges of the pouch P while holding the center portion of the mounting portion IP of the spout S by suction. In such a case, compared with a conventional spout mounting method in which, because the spot-sealing is to be applied at the center portion of the mounting portion IP of the spout S as shown in FIG. 13, it is necessary to hold two locations of the pouch P on the outward sides in the width direction by suction so as to open the opening edges of the pouch P, the opening amount of the opening edges of the pouch P is increased, which can advantageously make it easier to insert the spout S into the pouch P. This structure is especially effective for small-size pouches in which the width of the pouch P is small and the opening edges cannot be opened sufficiently wide.

While, in the above example, a rectangle shape is adopted as the shape of the spot-sealed portion PS, the shape of the spot-sealed portion PS is not limited to this example and may be various shapes including a circular shape, an elliptical shape, a star shape, a linear shape, and so on.

Also, although in the above example the spot-sealed portion PS is located at a position outwardly distant from the side edge of the mounting portion IP of the spout S by 1 mm, the position of the spot-sealed portion PS is not limited to this example, and the distance between the side edge of the mounting portion IP of the spout S and the spot-sealed portion PS may be set to 0.5 to 5.0 mm, preferably to 0.5 to 2.0 mm.

Also, while in the above example, the outer sheets are fixed together by spot-sealing, the present invention is not limited to this structure. For example, when the edge of the folded portion of the gusset sheet GS extends to the vicinity of the side edge of the mounting portion IP of the spout S, spot-sealing may be partially applied to the gusset sheet GS.

Figure 8A:
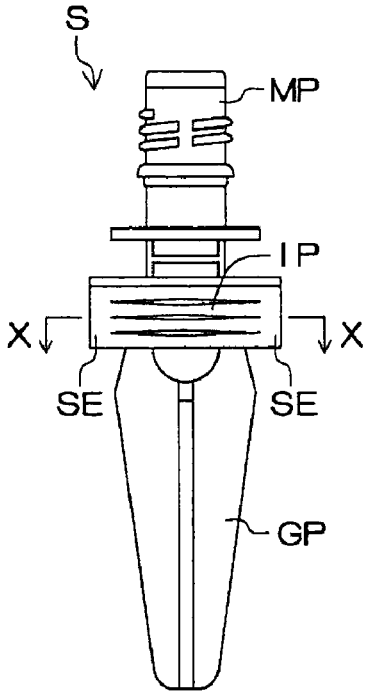
FIG. 8(*a*) is a side view showing a modification example of a spout.
Figure 8B:
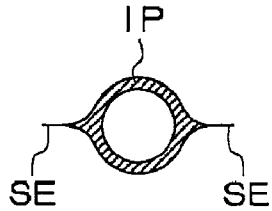
Figure 9:
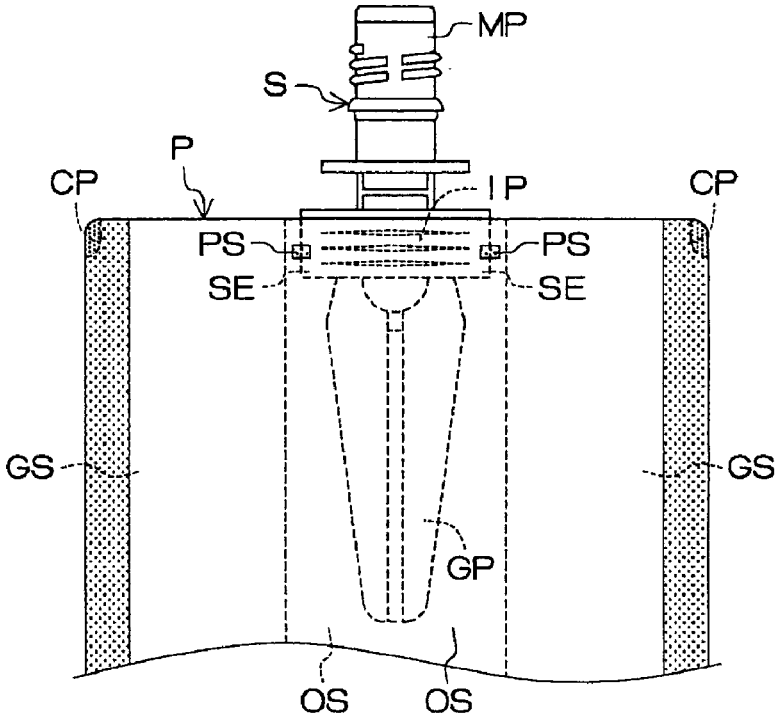
FIG. 9 is a partial front view showing the above spout in a temporarily fixed state.

In addition, while in the above example, the opening edges of the pouch P are fixed together by spot-sealing at locations on the outward sides with respect to the both side edges of the mounting portion IP of the spout S, the present invention is not limited to this structure. For example, when each of side edges SE of the mounting portion IP of the spout S in the width direction of the pouch, which is to be fixed to the opening edges of the pouch P by heat-sealing, is formed in a flat thin shape as shown in FIGS. 8(*a*) and 8(*b*), by fixing the opening edges of the pouch P and the flat thin side edges SE of the mounting portion IP of the spout S together by spot-sealing during the temporary fixation process as shown in FIG. 9, the ability to hold the spout S with respect to the pouch P in the temporary fixation state can be increased, compared with the above-described case in which the opening edges of the pouch P are fixed together by spot-sealing at locations on the outward sides of the both side edges of the mounting portion IP of the spout S, without significantly increasing the time required for temporary fixation of the spout S.

Figure 10A:
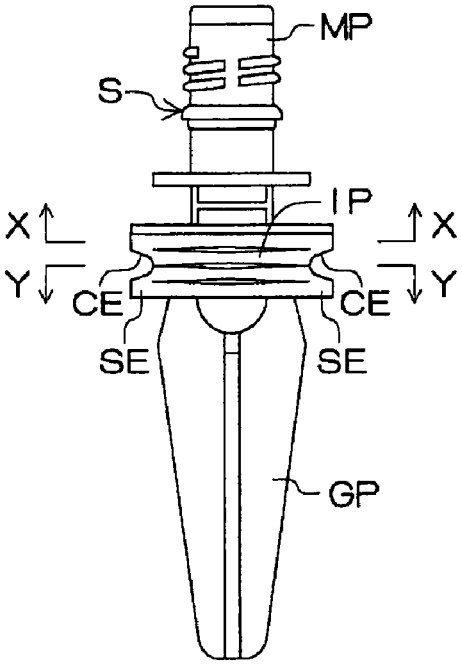
FIG. 10(*a*) is a side view showing another modification example of a spout.
Figure 10B:
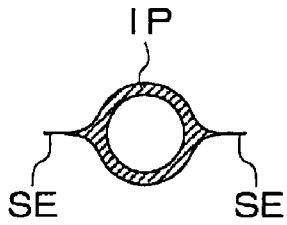
Figure 10C:
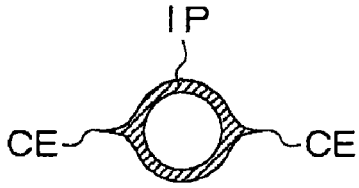
Figure 11:
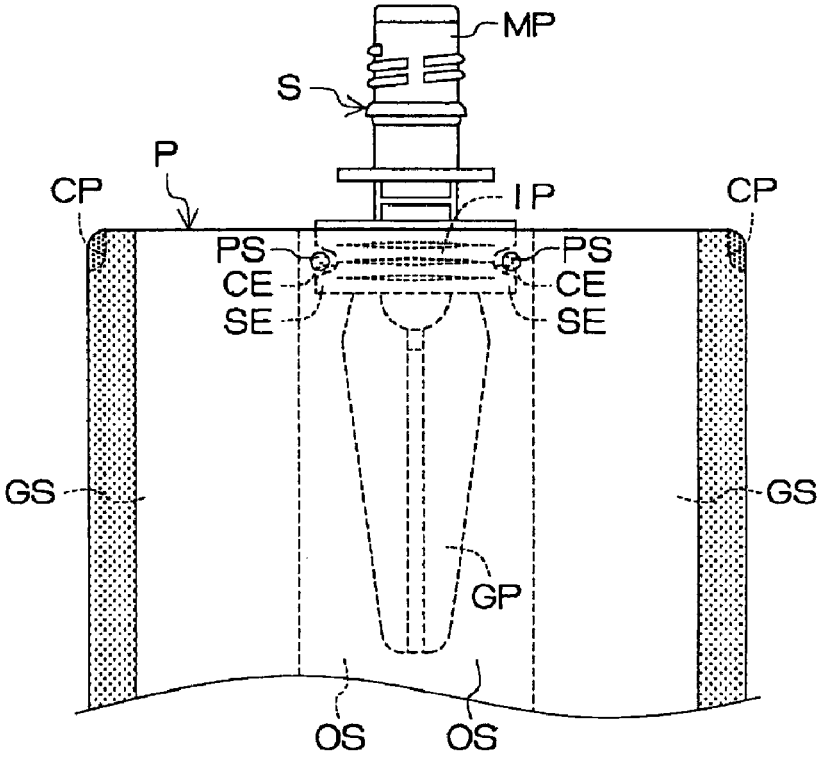
FIG. 11 is a partial front view showing the above spout in a temporarily fixed state.

Further, when both side edges SE of the mounting portion IP of the spout S are formed in a flat thin shape as described above, a cut edge portion CE is formed in the flat thin side edge SE as shown in FIGS. 10(*a*) to 10(*c*). Then, during the temporary fixation process, by fixing the opening edges of the pouch P together by spot-sealing near the both side edges SE of the spout S such that the sealed region is fitted in the cut edge portion CE formed in the flat thin side edge SE of the mounting potion IP of the spout S, as shown in FIG. 11, the ability to hold the spout S with respect to the pouch P in the temporary fixation state can be increased with completely no increase in the time required for temporary fixation of the spout S, compared with the above-described case in which the opening edges of the pouch P are fixed together by spot-sealing at locations on the outward sides of the both side edges of the mounting portion IP of the spout S.

It is also obvious that the spout mounting method and the spout of the present invention are applicable not only to a side gusset type pouch container having a spout, but also to bottom gusset type and flat bag type pouch containers having a spout.

INDUSTRIAL APPLICABILITY

As described above, the spout mounting method and the spout according to the present invention are valuable in achieving smooth and high-speed mounting operation of a spout onto a pouch at the time of mass production of a pouch container provided with a spout. In particular, the spout according to the present invention is suitable for enhancing the ability to hold the spout with respect to the pouch in a temporary fixation state without increasing the time required for temporary fixation of the spout.

REFERENCE NUMERALS

1 SPOUT MOUNTING DEVICE
2 POUCH TRANSPORTING UNIT
3 POUCH PRELIMINARY OPENING UNIT
4 SPOUT INSERTION AND TEMPORARY FIXATION UNIT
5 SPOUT MOUNTING UNIT
21 OPEN/CLOSE BELT TRANSPORTING MECHANISM
22 BELT TRANSPORTING MECHANISM
31 PRELIMINARY SUCTION HEAD
41 SUCTION HEAD
42 DRIVING CYLINDER
43 PISTON ROD

44*a*, 44*b* SEALING HEAD
45 DRIVING CYLINDER
46 PISTON ROD
51 FIRST SEALING BAR
52 SECOND SEALING BAR
53 COOLING BAR
P POUCH
OS OUTER SHEET
GS GUSSET SHEET
S SPOUT
PS SPOT SEALED PORTION
MP MOUTH PORTION
IP MOUNTING PORTION
GP GUIDE PORTION
CE CUT EDGE PORTION
SE SIDE EDGE

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

The invention claimed is:

1. A spout mounting method for mounting a spout having a mounting portion onto a pouch, the spout mounting method comprising:

inserting the spout into the pouch such that the mounting portion of the spout is held between opening edges of the pouch which have not been sealed;

temporarily fixing the spout which is inserted into the pouch to the pouch; and fixing the mounting portion of the spout which is temporarily fixed to the pouch onto the pouch by heat-sealing, wherein during the temporarily fixing the spout, the opening edges of the pouch are fixed together near both side edges of the mounting portion of the spout by spot-sealing, such that the spout is held by the opening edges of the pouch.

2. The spout mounting method according to claim 1, wherein at least one side edge of the mounting portion of the spout in the width direction of the pouch, which is to be fixed to the opening edges of the pouch by heat-sealing, is formed in a flat thin shape; and at the time of fixing the opening edges of the pouch together by spot-sealing during the temporarily fixing the spout, the opening edges of the pouch and the flat thin side edge in the mounting portion of the spout are fixed together by spot-sealing.

3. A spout mounting device for mounting a spout having a mounting portion onto a pouch, the spout mounting device comprising:

an insertion unit structured to insert the spout into the pouch such that a mounting portion of the spout is held between opening edges of the pouch which have not been sealed;

a temporary fixation unit structured to temporarily fix the spout which is inserted into the pouch to the pouch;

a sealing unit structured to fix the mounting portion of the spout which is temporarily fixed to the pouch onto the pouch by heat-sealing, and a pair of suction heads that, prior to insertion of the spout into the pouch by the insertion unit, hold substantially center portions of the pouch corresponding to a portion into which the spout is to be inserted, by suction and withdraw away from each other to thereby open the opening edges of the pouch;

wherein the temporary fixation unit is structured to fix the opening edges of the pouch together by spot-sealing near both side edges of the mounting portion of the spout, such that the spout is held by the opening edges of the pouch;

the temporary fixation unit includes sealing heads for fixing the opening edges of the pouch together by spot-sealing, the sealing heads being provided on both sides of each of the pair of suction heads such that the suction head is interposed between the seal heads.

4. The spout mounting device according to claim 3, wherein at least one side edge of the mounting portion of the spout in the width direction of the pouch, which is to be fixed to the opening edges of the pouch by heat-sealing, is formed in a flat thin shape; and at the time of fixing the opening edges of the pouch together by spot-sealing, the temporary fixation unit fixes the opening edges of the pouch and the flat thin side edge in the mounting portion of the spout together by spot-sealing.

5. The spout mounting device according to claim 3, wherein at least one side edge of the spout in the width direction of the pouch is formed in a flat thin shape;

a portion of the side edge having a flat thin shape is cut out toward the center of the mounting portion to form a cut edge portion; and the temporary fixation unit fixes the opening edges of the pouch together near both side edges of the mounting portion of the spout by spot-sealing, such that a sealed region is fitted in the cut edge portion formed in the side edge of the mounting portion of the spout having a flat thin shape.

6. The spout mounting device according to claim 3, wherein the steps of opening the opening edges, inserting the spout, and temporary fixation of the spout are performed in a state in which the pouch is located at a predetermined transport position.

7. The spout mounting device according to claim 6, wherein the pouch is in a substantially bag shape, with both side edges thereof being previously fixed together by heat-sealing.

8. A spout mounting method for mounting a spout onto a pouch, the spout having a mounting portion to be fixed to an opening edge of the pouch by heat-sealing, the mounting portion including at least one side edge in the width direction of the pouch which is formed in a flat thin shape, wherein a portion of the side edge having a flat thin shape is cut out toward the center of the mounting portion to form a cut edge portion, the spout mounting method comprising:

inserting the spout into the pouch such that the mounting portion of the spout is held between opening edges of the pouch which have not been sealed;

temporarily fixing the spout which is inserted into the pouch to the pouch; and fixing the mounting portion of the spout which is temporarily fixed to the pouch onto the pouch by heat-sealing, wherein during the temporarily fixing the spout, the opening edges of the pouch are fixed together near both side edges of the mounting portion of the spout by spot-sealing, such that a sealed region is fitted in the cut edge portion formed in the side edge of the mounting portion of the spout having a flat thin shape.

* * * * *